United States Patent [19]

Kuriyama

[11] Patent Number: 5,025,427

[45] Date of Patent: Jun. 18, 1991

[54] ELECTRONIC DISPLAY DEVICE FOR DISPLAYING CALENDAR INFORMATION

[75] Inventor: Yuji Kuriyama, Tokyo, Japan

[73] Assignee: Casio Computer Co., Ltd., Tokyo, Japan

[21] Appl. No.: 513,567

[22] Filed: Apr. 24, 1990

[30] Foreign Application Priority Data

Apr. 28, 1989 [JP] Japan ..... 1-49707[U]

[51] Int. Cl.[5] ..... G04B 19/24

[52] U.S. Cl. ..... 368/29

[58] Field of Search ..... 368/28–30

[56] References Cited

U.S. PATENT DOCUMENTS

| | | | |
|---|---|---|---|
| 4,205,516 | 6/1980 | Terao | 368/29 |
| 4,233,681 | 11/1980 | Murata | 368/29 |
| 4,270,192 | 5/1981 | Kudo | 368/29 |
| 4,303,995 | 12/1981 | Aizawa | 368/30 |
| 4,415,271 | 11/1983 | Mori | 368/28 |
| 4,428,681 | 1/1984 | Kashio | 368/29 |
| 4,540,292 | 9/1985 | Rubenstein et al. | 368/29 |

FOREIGN PATENT DOCUMENTS

| | | | |
|---|---|---|---|
| 53-19069 | 2/1978 | Japan | 368/29 |

*Primary Examiner*—Vit W. Miska

*Attorney, Agent, or Firm*—Frishauf, Holtz, Goodman & Woodward

[57] ABSTRACT

An electronic device having a calendar display function is capable of changing calendar formats to be presented on a display screen. The formats include a "Sunday through Saturday" mode and a "Monday through Sunday" mode. The device comprises a date counter which counts a date number from the first to the last days of a month. These date data are written into a display memory for the display screen and then are displayed on the display screen at appropriate locations which are different depending on which mode has been selected, in order to provide a desired calendar format.

13 Claims, 3 Drawing Sheets

| | | | | | | |
|---|---|---|---|---|---|---|
| 0 | 1 | 2 | 3 | 4 | 5 | 6 |
| 7 | 8 | 9 | 10 | 11 | 12 | 13 |
| 14 | 15 | 16 | 17 | 18 | 19 | 20 |
| 21 | 22 | 23 | 24 | 25 | 26 | 27 |
| 28 | 29 | 30 | 31 | 32 | 33 | 34 |
| 35 | 36 | | | | | |

FIG. 2

101

| SU | MO | TU | WE | TH | FR | SA |
|---|---|---|---|---|---|---|
| 1 | 2 | 3 | 4 | 5 | 6 | 7 |
| 8 | 9 | 10 | 11 | 12 | 13 | 14 |
| 15 | 16 | 17 | 18 | 19 | 20 | 21 |
| 22 | 23 | 24 | 25 | 26 | 27 | 28 |
| 29 | 30 | 31 | | | | |
| | | | | | | |

102

FIG. 3A

| MO | TU | WE | TH | FR | SA | SU |
|---|---|---|---|---|---|---|
| | | | | | | 1 |
| 2 | 3 | 4 | 5 | 6 | 7 | 8 |
| 9 | 10 | 11 | 12 | 13 | 14 | 15 |
| 16 | 17 | 18 | 19 | 20 | 21 | 22 |
| 23 | 24 | 25 | 26 | 27 | 28 | 29 |
| 30 | 31 | | | | | |

FIG. 3B

ELECTRONIC DISPLAY DEVICE FOR DISPLAYING CALENDAR INFORMATION

BACKGROUND OF THE INVENTION

1. Field of the Invention

The present invention relates to an electronic device for displaying calendar information on a display unit thereof. More particularly, the invention relates to an electronic device having a function to change calendar formats to be displayed on the display unit.

2. Description of the Related Art

In recent years, electronic devices, such as electronic calculators, have had many functions. Among them is a calendar display function. Such calendar display function typically displays one-month calendar information in a matrix fashion in a fixed format of "Sunday through Saturday". This format means that a week begins with Sunday.

The concept of what day is a first day of the week, however, is different according to countries and peoples having different customs and cultures. In fact, in some cultures, Monday is a first day of the week. Thus, the calendar format "Monday through Sunday" is used in many countries. For users in these countries, electronic devices capable of displaying only one calendar display format "Sunday through Saturday" are clearly undesired and inconvenient.

SUMMARY OF THE INVENTION

It is an object of this invention to provide an electronic display device capable of changing calendar formats to be displayed thereon by user.

In accordance with the invention, there is provided an electronic device which comprises:

display means, having a display screen, for displaying calendar information about at least one month, said display screen including first and second display sections; input means for inputting "year" and "month" data; calculating means for calculating calendar information based on "year" and "month" data inputted from said input means; designating means for variably designating a calendar display format defining an arrangement of days of week; and control means for controlling said display means to display the calendar information according to the display format designated by said designating means.

DESCRIPTION OF THE DRAWINGS

FIG. 2 is a schematic representation of a memory for calendar information;

FIGS. 3A and 3B are views of displayed calendars in "Sunday through Saturday" and "Monday through Sunday" modes, respectively.

DESCRIPTION OF THE PREFERRED EMBODIMENT

Figure 1:
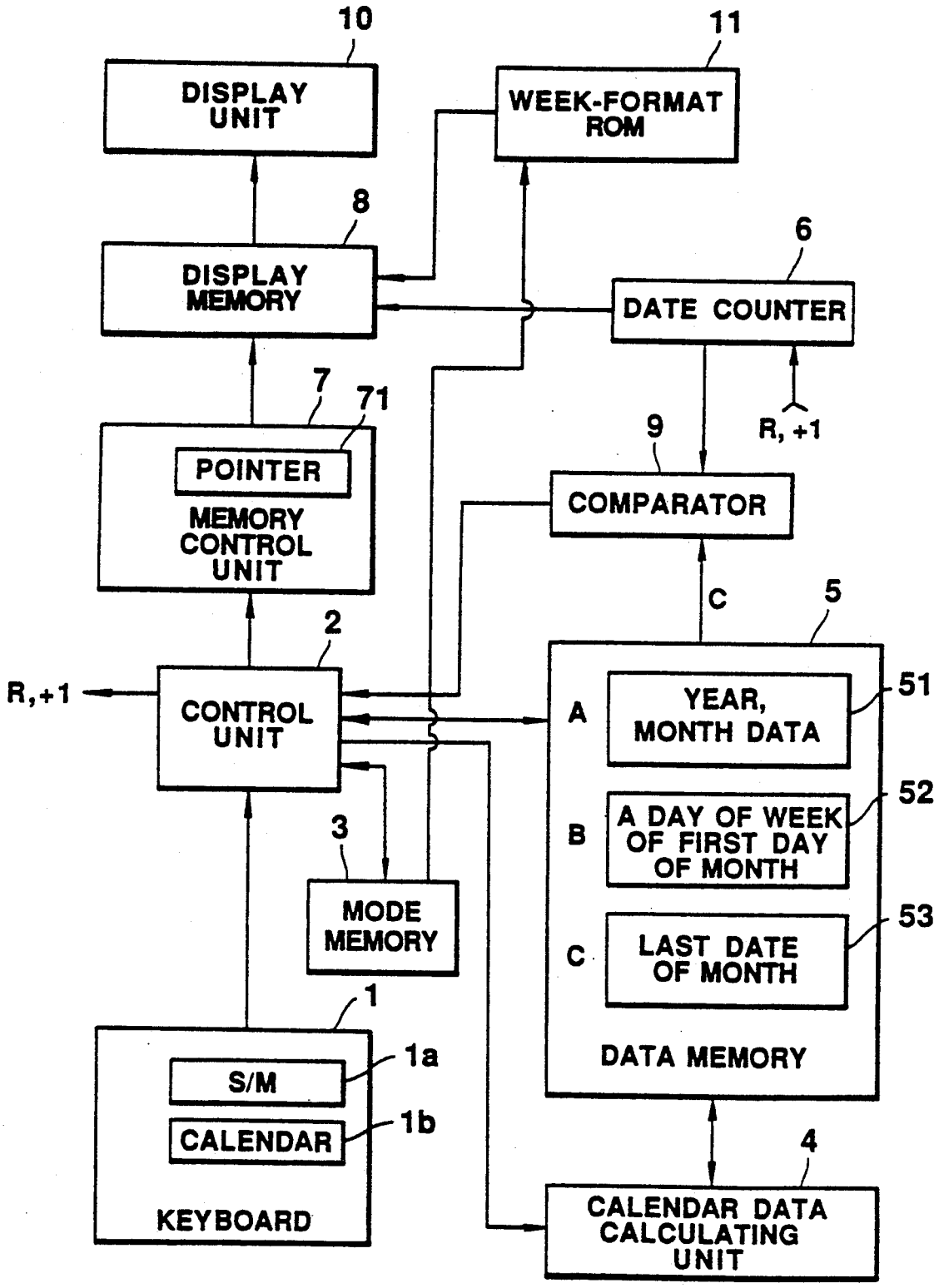
FIG. 1 is a block diagram of an electronic device according to an embodiment of the present invention.

Referring now to FIG. 1, there is shown an electronic display device having a calendar display function. The electronic device comprises keyboard 1 coupled to control unit 2. Keyboard 1 includes a "S/M" key 1*a* for designating or selecting a (monthly) calendar display mode from either "Sunday through Saturday" or "Monday through Sunday" mode, and "calendar" key 1*b* for causing displaying of the calendar. Keyboard 1 further includes other function keys and numerical keys, not shown in this figure.

Key input data from keyboard 1 is supplied to control unit 2. Control unit 2 includes read only memory (ROM) storing programs for controlling all circuits in the electronic device. Upon receiving "S/M" key input data from keyboard 1, control unit 2 writes or updates mode memory 3 with flag data indicative of the calendar display mode designated by the "S/M" key. Flag data "1" represents "Sunday through Saturday" mode, while flag data "0" represents "Monday through Sunday" mode. The flag is toggled by successive "S/M" key operations.

"Year" and "month" data are entered from keyboard 1 and transferred to A-register 51 in data memory 5 through control unit 2. Calendar data calculating unit 4 determines, based on the data of A-register 51, "day of the week" of the first day of the month associated with the "year" and "month" data stored in A-register 51 and "data of the month" of the last day of the same month. A method of this calculation is described in detail in U.S. Pat. No. 4,205,516, the entire contents of which are incorporated herein by reference. According to this calculation, Sunday to Saturday are represented by successive number "0" to "6" respectively.

First day data indicative of "day of the week", obtained by the calculation of the calendar data calculating unit 4, is stored in B-register 52, and the last day data indicative of "date of the month" is stored in C-register 53.

Date counter 6 is reset and incremented by control unit 2, when a calendar display function is performed. The count of the date counter 6 is supplied to comparator 9 for comparison with the last date data in C-register 53 in data memory 5. The comparison result of the comparator 9 is inputted to control unit 2 which uses it to terminate the task of calendar display.

Display memory 8 stores date data for display areas of display unit 10. Memory control unit 7 includes pointer 71 which locates an area of display memory 8 where date data from the date counter 6 is stored. Correspondence between areas in display memory 8 and values of pointer 71 are shown in FIG. 2.

Display unit 10 comprises first or day display area 101 for displaying days of the week, and second or date display area 102 for displaying calendar dates of one month, as shown in FIG. 3A or FIG. 3B. These display areas preferably comprise a matrix type liquid crystal display unit. The first display area 101 is divided into seven day display blocks, and the second display area 102 has thirty-seven display blocks therein. Dates (numeral) and days of the week (characters) are indicated by dot matrix patterns. The "days of week" data, which is week pattern data to be displayed on the first display area 101, is supplied from week-format ROM 11 which stores two different week-format data, "SU MO . . . SA" and "MO TU . . . SU". One of them is selected by the flag state of mode memory 3.

Operation of the above-described device will be described below with reference to FIGS. 1 to 4.

Figure 4:
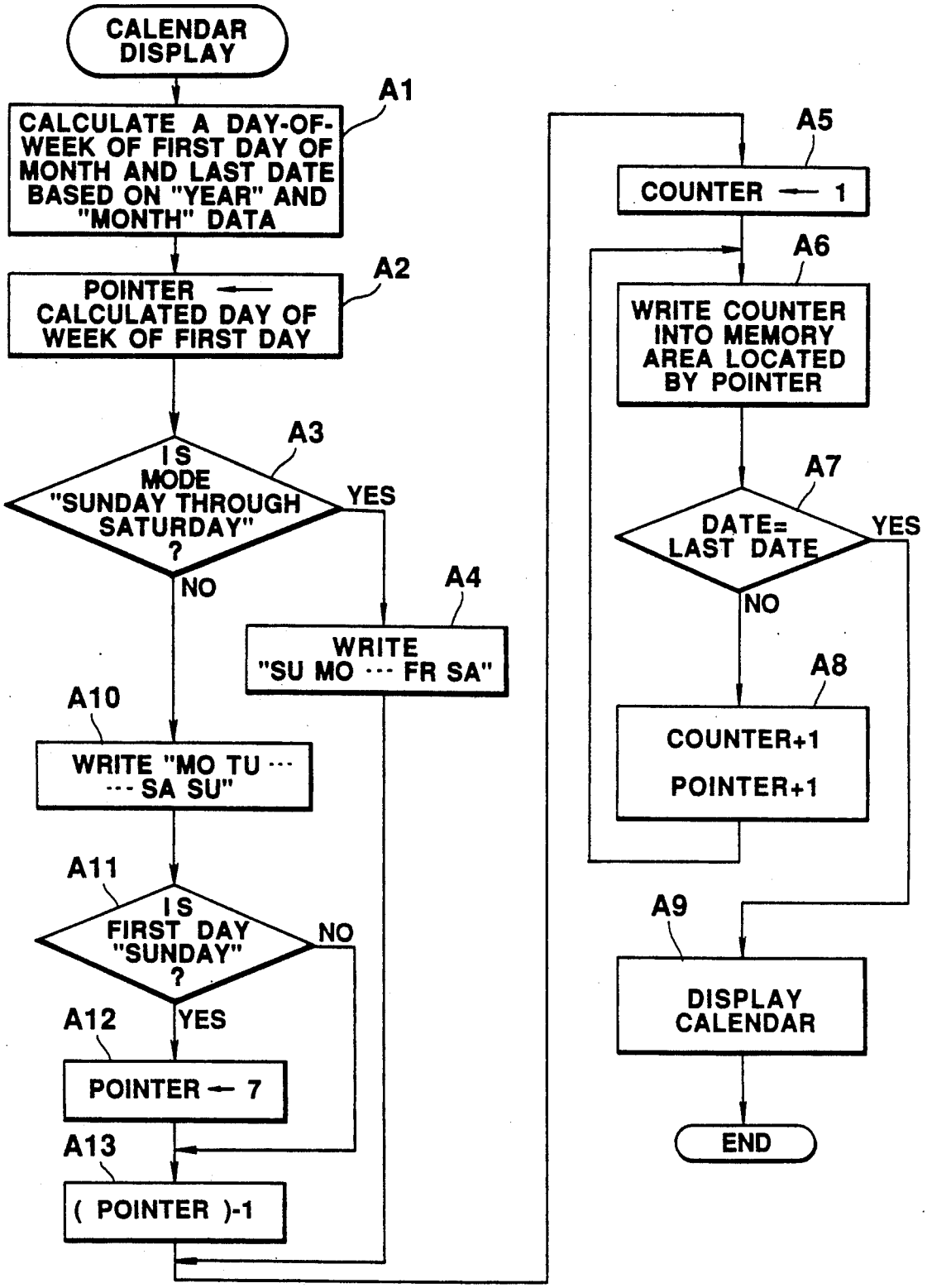
FIG. 4 is a flow chart of an operation of the illustrated embodiment.

When calendar display function is performed, its mode is previously set to either "Sunday through Saturday" mode or "Monday through Sunday" mode according to "S/M" key operation. Then "year" and "month" data is inputted and "calendar" key 1*b* is depressed. The inputted "year" and "month" data is stored into A-register 51 and a calendar displaying process represented by the flow chart or FIG. 4 is performed.

It is assumed here that "1989" as year data and "1 (January)" as month data are inputted from keyboard 1.

At first, calendar data calculating unit 4 determines "day of the week" of the first day of the month and "last date" of the month in step Al. This results in day data of "0 (Sunday)" for the first day of the month of January (1989) and date data of "31" for the last day of the month. The first day data "0" is entered into B-register 52, and the last date data "31" is entered into C-register 53. Then the pointer 71 is set to the first day data in step A2. In this case, the pointer 71 is set to "0".

Next, in step A3, the display mode is checked. If the "Sunday through Saturday" mode has been set by mode memory 3, the process is advanced to step A4. In step A4, the pattern of SU MO TU . . . SA" is read out from week-format ROM 11 and entered into the display memory 8 at locations corresponding to the day display area 101 of the display unit 10.

In step A5, control unit 2 sends a signal to reset the date counter 6 to "1" indicative of the first date. In step A6, this count "1" is written into the display memory 8 at a location pointed by the pointer 71, here, having a value of "0". In the next step A7, the comparator 9 compares the count of the date counter 6 with the last date data of "31" in C-register 53. The comparison results in a mismatch here, so that process goes to step A8 in which date counter 6 and pointer 71 are incremented by one. At the next step A6, the incremented value "2" of the date counter 6 is written into the display memory 8 at a second date location specified by the pointer 71 having a value of "1".

The loop of the steps A6, A7 and A8 is repeated until the incremented value of date counter 6 reaches the last date value of C-register 53. Thus, the successive counts "3,4, . . . " of date counter 6 are written into the display memory 8 at locations pointed by pointer 71 value of "2,3, . . . ", respectively. When the last date value "31", of date counter 6 is written into the display memory 8 at a location addressed by the pointer 71 value "30" at step A6, the process is advanced to the next step A9 through step A7 to display the calendar of "1989, January" on the display unit 10 as shown in FIG. 3A.

If "Monday through Sunday" mode is found in step A3, the process moves the step A10 in which the pattern of MO TU WE . . . SU" is read out from week-format ROM 11 and written into display memory 8. This week-format data is displayed on the first display area 101 of the display unit 10. The next step All checks to see whether or not "day of the week" of the first day of the month is Sunday. Since "1989. 1. January" is Sunday as described above, this is the case where the process goes to step A12. In step A12, the pointer 71 is set to "7". And then the value of pointer 71 is decremented by one at step A13. This descrementing process means changing the calendar display format from "Sunday through Saturday" mode to "Monday through Sunday" mode. The step A12, which changes the pointer 71 to "7" from "0" previously set in step A2, is to avoid an invalied calculation "0–1" in step A13 when the first day of the month is Sunday.

In step A5 after step A13, the date counter 6 is initialized to "1". In the next step A6, this "1" is entered into the display memory area designated by pointer 71, which value is now "6" and is shown to point to the memory location of "6"in FIG. 2. The process represented by steps A6–A8 is the same as described before. The final step A8 controls the display unit 10 to indicate the month calendar of "1989, January" in the Monday through Sunday"mode as shown in FIG. 3B.

If "day of the week" the first day of the month is not Sunday, the check in step All yields NO. In this case, the process directly moves from step All to step A13 in which the "day of week" value of the first day of the month is decremented by one. The process after step A13 is the same as mentioned before.

As seen from above, the calendar display format is easily changed by a key operation between "Sunday through Saturday" and "Monday through Sunday" modes. This will help users make their own time schedules and proceed with their work accordingly.

Various modifications and alternations of the illustrative embodiment will be obvious to a person skilled in the art without departing from the scope of the invention as defined by the appended claims. For example, other calendar display modes may be provided in which a week is shown to start with a day other than Sunday or Monday.

What is claimed is:

1. An electronic device comprising:

display means, having a display screen, for displaying calendar information about at least one month, said display screen including a first display section arranged to display days-of-week information and a second display section, arranged to display date information about a month, having a plurality of display lines, each line having seven display areas;

input means for inputting "year" and "month" data;

calculating means for calculating calendar information base on "year" and "month" data inputted from said input means;

designating means for variably designating a calendar display format defining an arrangement of days of the week; and control means for controlling said display means to display the calendar information according to the display format designated by said designating means, including means for displaying the days-of-week information on said first display section and means for entering date information into said display areas of said second display section in a manner corresponding to the displayed day-of-week information.

2. An electronic device according to claim 1, comprising:

memory means for storing a plurality of different display patterns each representing days-of-week to be displayed on said first display section; wherein said control means further includes:

selecting means responsive to said designating means for selecting one of said display patterns from said memory means to be displayed on said first display section.

3. An electronic device according to claim 2, wherein said memory means includes means for storing at least a "Sunday through Saturday" display pattern and a "Monday through Sunday" display pattern.

4. An electronic device according to claim 1, wherein said means for entering date data includes:

counting means for counting numbers from a number "1", and moving means for moving the numbers of said counting means into said display areas.

5. An electronic device according to claim 4, wherein said calculating means includes means for obtaining "a day of the week" of a first day of a month.

6. An electronic device according to claim 5, wherein said moving means includes means for starting entering data from a display area of a first line corresponding to the day of the week obtained by said means for obtaining.

7. An electronic device according to claim 6, wherein said calculating means includes means for determining the last date data of the month, and said counter means is incremented by one until its count reaches the last date data.

8. An electronic device according to claim 4, wherein said display areas of said second display section are numbered by 0 to 36, with "0" corresponding to a first area of a first line and with "36" corresponding to a second area of a sixth line, and said moving means includes pointer means for successively pointing to difference ones of said display areas.

9. An electronic device according to claim 8, wherein said moving means includes:

first means selectively responsive to said designating means for initializing said pointer means to a first day value from said means for calculating, indicative of "a day of the week" of a first day of a month when a "Sunday through Saturday" mode has been designated; and second means selectively responsive to said designating means for initializing said pointer means to a value decreased by one from said first day value from said means for calculating when a "Monday through Sunday" mode has been designated.

10. An electronic device according to claim 9, wherein said counting means is incremented by one, and its incremented count is entered into said second display section at a display area pointed to by said pointer means each time when said pointer means is incremented by one.

11. An electronic device according to claim 2, wherein said designating means includes:

key input means for directing a change in a calendar display format between a "Sunday through Saturday" mode and a "Monday through Sunday" mode.

12. An electronic device according to claim 11, wherein said control means includes:

memory means for storing a "Sunday through Saturday" display pattern and a "Monday through Sunday" display pattern; and counting means for counting numbers from a number "1";

said means for displaying the days-of-week information includes means for selecting one of the display patterns from said memory means, and said means for entering date data includes means for entering the number counted by said counting means into said display areas of said second display section in order.

13. An electronic device according to claim 12, wherein said calculating means includes means for obtaining "a day of the week" of a first day of a month and the last date data of the month, and said means for entering the counted number includes means for entering data beginning from a display area corresponding to the first day of the month.

* * * * *